US011850858B2

(12) United States Patent
Mizuno et al.

(10) Patent No.: US 11,850,858 B2
(45) Date of Patent: Dec. 26, 2023

(54) LIQUID DISCHARGE HEAD

(71) Applicant: Brother Kogyo Kabushiki Kaisha, Nagoya (JP)

(72) Inventors: Taisuke Mizuno, Yokkaichi (JP); Jiro Yamamoto, Nagoya (JP); Shohei Koide, Nagoya (JP); Takaaki Yoshino, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 48 days.

(21) Appl. No.: 17/563,822

(22) Filed: Dec. 28, 2021

(65) Prior Publication Data

US 2022/0274404 A1 Sep. 1, 2022

(30) Foreign Application Priority Data

Feb. 26, 2021 (JP) ..... 2021-029668

(51) Int. Cl.
*B41J 2/14* (2006.01)

(52) U.S. Cl.
CPC ..... *B41J 2/14233* (2013.01)

(58) Field of Classification Search
None
See application file for complete search history.

(56) References Cited

U.S. PATENT DOCUMENTS

2003/0222949 A1 12/2003 Ito
2006/0066689 A1* 3/2006 Hori ..... B41J 2/161 347/68
2008/0079775 A1* 4/2008 Chikamoto ..... B41J 2/1623 347/47
2013/0242012 A1* 9/2013 Hayashi ..... B41J 2/14274 347/93

FOREIGN PATENT DOCUMENTS

JP 2004-160874 A 6/2004

* cited by examiner

*Primary Examiner* — Erica S Lin
(74) *Attorney, Agent, or Firm* — Banner & Witcoff, Ltd.

(57) ABSTRACT

There is provided liquid discharge head including: channel substrate which has first surface; and actuator substrate having second surface. A trap chamber configured such that the adhesive is trapped in the trap chamber in a case that the first and second surfaces are adhered to each other, an inflow channel configured such that the adhesive flows into the inflow channel, and an atmosphere communicating channel are formed in the channel substrate. The trap chamber has first and second ends in first direction and first and second ends in second direction. End of the inflow channel is located at the first end in the first direction and the second end in the second direction of the trap chamber. End of the atmosphere communicating channel is located at the second end in the first direction and the first end in the second direction of the trap chamber.

13 Claims, 5 Drawing Sheets

LIQUID DISCHARGE HEAD

CROSS REFERENCE TO RELATED APPLICATIONS

The present application claims priority from Japanese Patent Application No. 2021-029668, filed on Feb. 26, 2021, the disclosure of which is incorporated herein by reference in its entirety.

BACKGROUND

The present disclosure relates to a liquid discharge head provided with a channel substrate and an actuator substrate which are adhered to each other via an adhesive.

There is a known configuration wherein a plurality of plates constructing a cavity unit (channel substrate) are stacked on each other via an adhesive, a release groove is formed on a surface of a plate, among the plurality of plates, to which the adhesive is applied. With this, any excessive portion of the adhesive is caused to flow into the release groove, thereby making it possible to suppress such a situation that the adhesive adheres or sticks to another member (for example, a pressure-joining device, etc.).

SUMMARY

According to an aspect of the present disclosure, there is provided a liquid discharge head including a channel substrate and an actuator substrate.

A plurality of individual channels is formed in the channel substrate and the channel substrate has a first surface, each of the plurality of individual channels including a nozzle and a pressure chamber communicating with the nozzle.

The actuator substrate has a second surface which is adhered to the first surface via an adhesive, and has a plurality of individual electrodes each of which overlaps with the pressure chamber of one of the plurality of individual channels as seen in a first direction orthogonal to the first surface and the second surface.

A trap chamber configured such that the adhesive is trapped in the trap chamber in a case that the first and second surfaces are adhered to each other via the adhesive, an inflow channel configured such that the adhesive flows into the inflow channel toward the trap chamber in a case that the first and second surfaces are adhered to each other via the adhesive, and an atmosphere communicating channel configured to communicate the trap chamber with atmosphere are formed in the channel substrate.

The inflow channel has a first end which is opened in the first surface and a second end which is connected to the trap chamber.

The atmosphere communicating channel has a first end which is opened in the first surface, which does not overlap with the actuator substrate as seen in the first direction and which is communicated with the atmosphere, and a second end which is connected to the trap chamber.

A distance between the first end of the atmosphere communicating channel and an outer edge, of the first surface, in a second direction orthogonal to the first direction is smaller than a distance between the first end of the inflow channel and the outer edge, of the first surface, in the second direction.

The trap chamber has a first end and a second end in the first direction and a first end and a second end in the second direction, a distance between the first end in the first direction and the first surface being smaller than a distance between the second end in the first direction and the first surface, and a distance between the first end in the second direction and the outer edge of the first surface in the second direction being smaller than a distance between the second end in the second direction and the outer edge of the first surface in the second direction.

The second end of the inflow channel is located at the first end in the first direction and the second end in the second direction of the trap chamber.

The second end of the atmosphere communicating channel is located at the second end in the first direction and the first end in the second direction of the trap chamber.

According to an aspect of the present disclosure, there is provided a liquid discharge head including a channel substrate and an actuator substrate.

A plurality of individual channels is formed in the channel substrate and the channel substrate has a first surface, each of the plurality of individual channels including a nozzle and a pressure chamber communicating with the nozzle.

The actuator substrate has a second surface which is adhered to the first surface via an adhesive, and has a plurality of individual electrodes each of which overlaps with the pressure chamber of one of the plurality of individual channels as seen in a first direction orthogonal to the first surface and the second surface.

A trap chamber configured such that the adhesive is trapped in the trap chamber in a case that the first and second surfaces are adhered to each other via the adhesive, an inflow channel configured such that the adhesive flows into the inflow channel toward the trap chamber in a case that the first and second surfaces are adhered to each other via the adhesive, and an atmosphere communicating channel configured to communicate the trap chamber with atmosphere are formed in the channel substrate.

The inflow channel has a first end which is opened in the first surface and a second end which is connected to the trap chamber.

The atmosphere communicating channel has a first end which is opened in the first surface, which does not overlap with the actuator substrate as seen in the first direction and which is communicated with the atmosphere, and a second end which is connected to the trap chamber.

A distance between the first end of the atmosphere communicating channel and an outer edge, of the first surface, in a second direction orthogonal to the first direction is smaller than a distance between the first end of the inflow channel and the outer edge, of the first surface, in the second direction.

The trap chamber has a first end and a second end in the first direction and a first end and a second end in the second direction, a distance between the first end in the first direction and the first surface being smaller than a distance between the second end in the first direction and the first surface, and a distance between the first end in the second direction and the outer edge of the first surface in the second direction being smaller than a distance between the second end in the second direction and the outer edge of the first surface in the second direction.

The second end of the inflow channel is located at a first one of the first end and the second end in the first direction of the trap chamber and the second end of the atmosphere communicating channel is located at a second one of the first end and the second end in the first direction of the trap chamber, or the second end of the inflow channel is located at a first one of the first end and the second end in the second direction of the trap chamber and the second end of the atmosphere communicating channel is located at a second one of the first end and the second end in the second direction of the trap chamber.

DETAILED DESCRIPTION

Although Japanese Patent Application Laid-open No. 2004-160874 indicates the problem in a case of adhering a plurality of plates constructing a channel substrate to each other, a similar problem might occur also in a case of adhering an actuator substrate to the channel substrate. In view of this, it is considered to form, in the channel substrate, a trap chamber which traps the adhesive, an inflow channel to which the adhesive flows from a surface of the channel substrate (a surface to which the actuator substrate is adhered) toward the trap chamber, and an atmosphere communicating channel which communicates the trap chamber with the atmosphere. With this, by causing an excessive portion of the adhesive applied to the surface of the channel substrate to flow from the inflow channel into the trap chamber, it is possible to suppress such a situation that the adhesive adheres to another member.

However, depending on an aspect of arrangement of the inflow channel and the atmosphere communicating channel with respect to the trap chamber, there might arise such a problem that the adhesive overflows from one end of the atmosphere communicating channel (an end communicating with the atmosphere), and adheres to another member (a pressing device used for adhering the channel substrate and the actuator substrate, etc.). For example, in a case that the adhesive adheres to the pressing device and that the pressing device is used to assemble another member with respect to a stacked body of the channel substrate and the actuator substrate, the adhesive adhered to the pressing device might make the positioning of the another member with respect to the stacked body to be difficult.

An object of the present disclosure is to provide a liquid discharge head capable of suppressing any overflow of the adhesive, which adheres the channel substrate and the actuator substrate, from an end of the atmosphere communicating channel.

<The Overall Configuration of the Printer>

Figure 1:
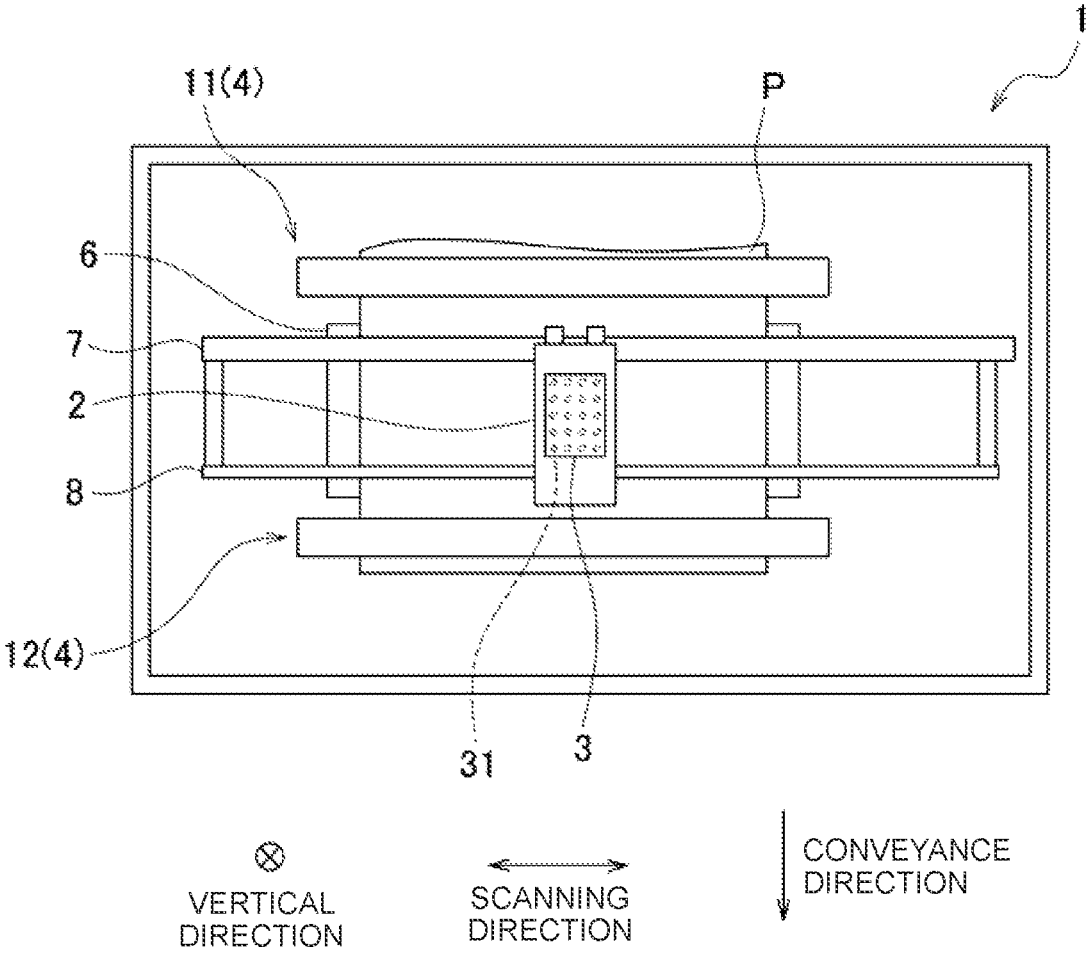
FIG. 1 is a schematic plan view of a printer 1 including a head 3.

As depicted in FIG. 1, a head (liquid discharge head) 3 according to an embodiment of the present disclosure is applied to a printer 1. The printer 1 is provided with a carriage 2 which is movable in a scanning direction (a direction orthogonal to the vertical direction) while holding the head 3, a platen 6 which supports a paper (paper sheet) P at a location below the head 3 and the carriage 2, and a conveyance mechanism 4 which conveys the paper P in a conveyance direction (a direction orthogonal to the scanning direction and the vertical direction). A plurality of nozzles 31 are formed in a lower surface of the head 3.

The carriage 2 is supported by a pair of guide rails 7 and 8 each of which extends in the scanning direction, and is moved in the scanning direction along the guide rails 7 and 8 by a driving of a carriage motor (not depicted in the drawings).

The conveyance mechanism 4 includes two roller pairs 11 and 12 which are arranged at positions, respectively, interposing the platen 6 and the carriage 2 in the conveyance direction therebetween. The roller pairs 11 and 12 rotate, by a driving of a conveyance motor (not depicted in the drawings), in a state that the roller pairs 11 and 12 hold or pinch the paper P. and convey the paper P in the conveyance direction.

<The Configuration of the Head>

Figure 2:
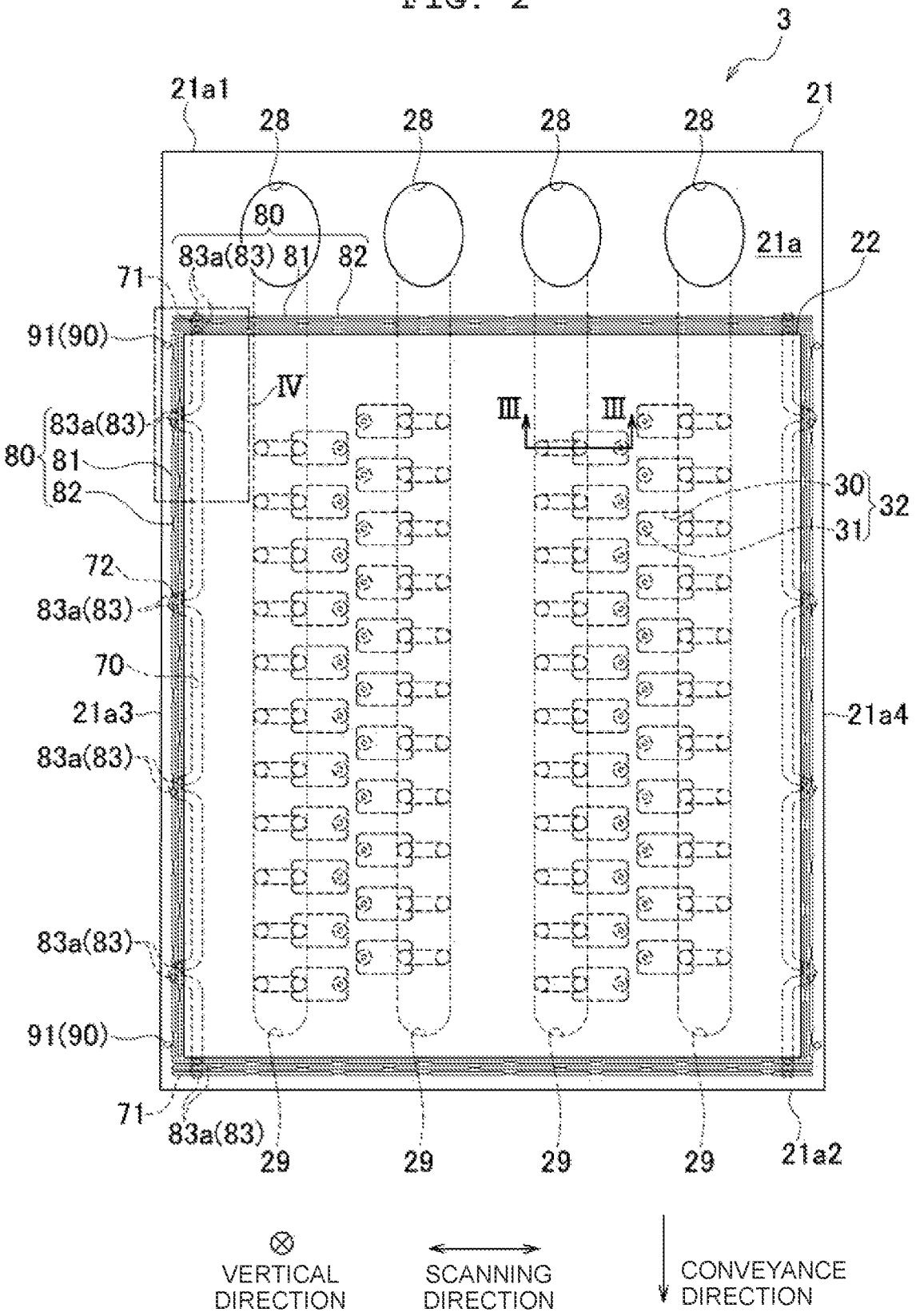
FIG. 2 is a plan view of the head 3.
Figure 3:
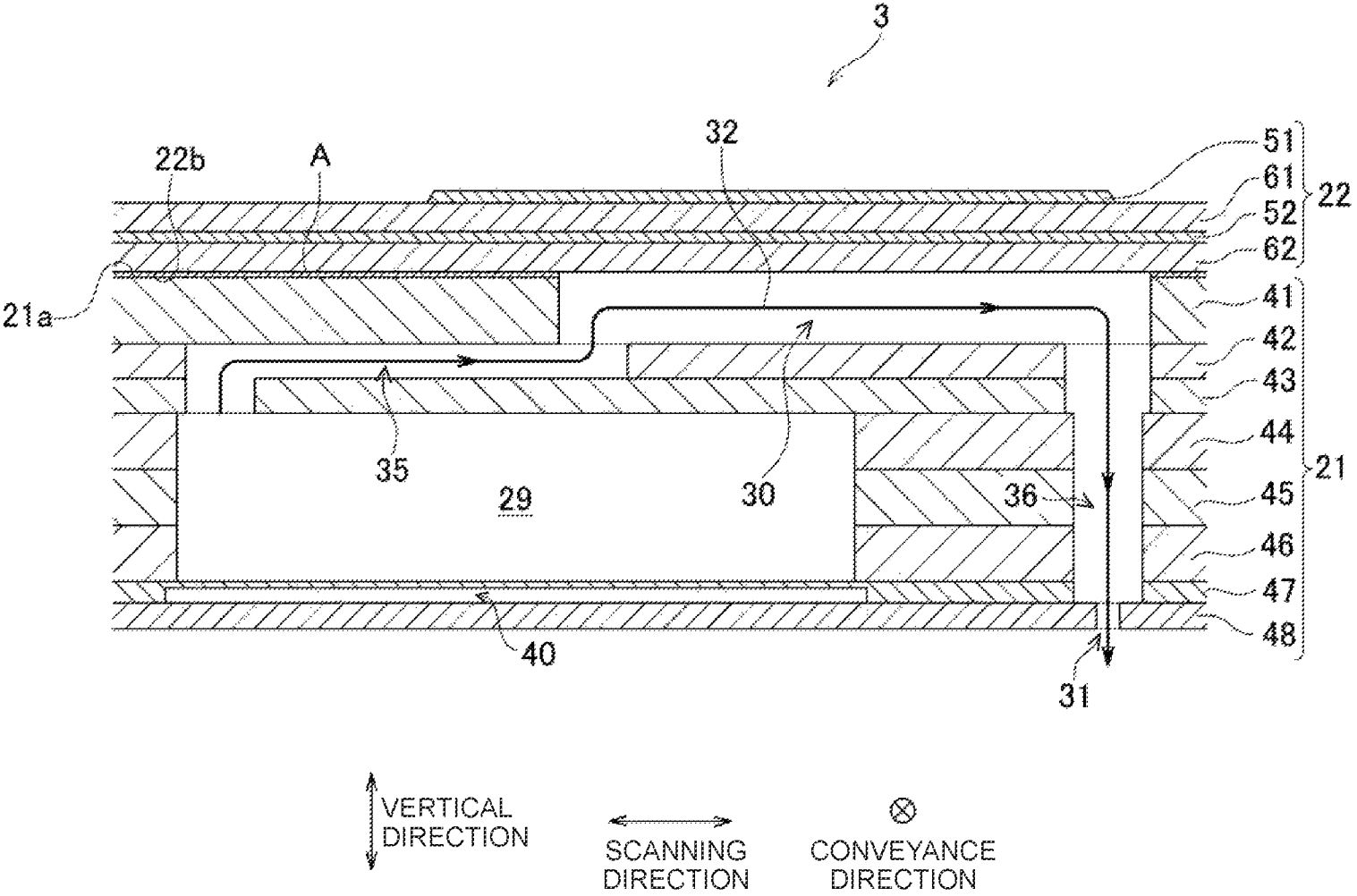
FIG. 3 is a cross-sectional view along a III-III line in FIG. 2.

As depicted in FIGS. 2 and 3, the head 3 includes a channel substrate 21 having the plurality of nozzles 31 formed therein, and an actuator substrate 22 arranged in an upper surface 21*a* (an example of a "first surface") of the channel substrate 21.

<The Configuration of the Channel Substrate>

As depicted in FIG. 3, the channel substrate 21 is constructed of eight plates 41 to 48 which are stacked in the vertical direction. A plurality of pressure chambers 30 are formed in the plate 41. As depicted in FIG. 2, each of the plurality of pressure chambers 30 is long in the scanning direction, as seen from the vertical direction. The plurality of nozzles 31 are formed in the plate 48. Four common channels 29 (see FIG. 2) are formed in the plates 44 to 46. Communicating channels 35, each of which communicates one of the plurality of pressure chambers 30 with one of the four common channels 29, are formed in the plates 42 and 43, each of the communicating channels 35 being formed corresponding to one of the plurality of pressure chambers 31. Communicating channels 36, each of which communicates one of the plurality of pressure chambers 30 with the one of the plurality of nozzles 31, are formed in the plates 42 to 47, each of the communicating channels 36 being formed corresponding to one of the plurality of pressure chambers 30.

As depicted in FIG. 2, the four common channels 29 extend from four ink supply ports 28, respectively, in the conveyance direction, and are arranged side by side in the scanning direction. The four ink supply ports 28 are formed in an upper surface of the plate 41 (namely, the upper surface 21*a* of the channel substrate 21), at an area at which the actuator substrate 22 is not arranged, and on the upstream side in the conveyance direction with respect to the actuator substrate 22. Each of the common channels 29 projects to the upstream side in the conveyance direction with respect to the actuator substrate 22. Each of the ink supply ports 28 is connected to an ink tank (not depicted in the drawings) via a tube, etc. An ink supplied from the ink tank to each of the ink supply ports 28 is supplied to one of the common channels 29.

Each of the four common channels 29 is provided on one of four pressure chamber row (arrays) each of which is constructed of pressure chambers 30 aligned in the conveyance direction. The four pressure chamber rows are arranged side by side in the scanning direction. The ink is supplied from one of the common channels 29 to the pressure chambers 30 belonging to each of the pressure chamber rows, via the communicating channels 35 (see FIG. 3). Further, by deformation of each of actuators of the actuator substrate 22 as will be described later on, pressure is applied to the ink in the pressure chamber 30, thereby discharging or ejecting the ink from the nozzle 31 via the communicating channel 36.

In such a manner, the channel substrate 21 is formed with the four common channels 29, and a plurality of individual channels 32 each of which communicates with one of the four common channels 29; each of the plurality of individual channels 32 is a channel including one of the plurality of nozzles 31 and one of the plurality of pressure chambers 30, and is a channel starting from an outlet of the common channel 29 and reaching the nozzle 31 via the communicating channel 35, the pressure chamber 30 and the communicating channel 36.

Further, a recessed part which constructs a damper chamber 40 is formed in the lower surface of the plate 47, at a position overlapping with each of the common channels 29 as seen in the vertical direction. The recessed part is closed by the plate 48.

<The Configuration of the Actuator Substrate>

As depicted in FIG. 3, the actuator substrate 22 is provided with a vibration plate 62, a common electrode 52, a piezoelectric body 61, and a plurality of individual electrodes 51. The vibration plate 62, the common electrode 52 and the piezoelectric body 61 cover all the pressure chambers 30 formed in the channel substrate 21. On the other hand, each of the plurality of individual electrodes 51 is provided on one of the plurality of pressure chambers 30, and is overlapped with one of the plurality of pressure chambers 30 in the vertical direction.

The vibration plate 62 is adhered, via an adhesive A, to the upper surface 21*a* of the channel substrate 21 (namely, the upper surface of the plate 41). A lower surface of the vibration plate 62 corresponds to a lower surface 22*b* (an example of a "second surface") of the actuator substrate.

The common electrode 52 is arranged on an upper surface of the vibration plate 62. The piezoelectric body 61 is arranged on an upper surface of the common electrode 52. The plurality of individual electrodes 51 are arranged on an upper surface of the piezoelectric body 61.

The plurality of individual electrodes 51 and the common electrode 52 are electrically connected to a driver IC (not depicted in the drawings). The driver IC maintains the potential of the common electrode 52 at the ground potential, whereas the driver IC changes the potential of each of the plurality of individual electrodes 51 between a predetermined driving potential and the ground potential. In this situation, parts (actuator), of the vibration plate 62 and the piezoelectric body 61, respectively, which are sandwiched between each of the plurality of individual electrodes 51 and one of the plurality of pressure chambers 30 corresponding thereto is deformed so as to project toward the pressure chamber 30, thereby changing the volume of the pressure chamber 30 and imparting the pressure to the ink inside the pressure chamber 30. The ink is discharged or ejected, via the communicating channel 36, from one of the plurality of nozzles 31 corresponding to the pressure chamber 30. At the same time with this, the ink inside the common channel 29 passes through the communicating channel 35 and is supplied to the pressure chamber 30, and the ink is supplied from the ink tank to the common channel 29.

As depicted in FIG. 2, the actuator substrate 22 has a rectangular shape which is a size smaller than the channel substrate 21 as seen from the vertical direction, and has a length in the conveyance direction longer than a length in the scanning direction. The outer shape of the actuator substrate 22 is defined by the vibration plate 62 and the common electrode 52.

Here, the vertical direction corresponds to an example of a "first direction" of the present invention, the scanning direction corresponds to an example of a "second direction" of the present invention, and a direction along the conveyance direction corresponds to an example of a "third direction" of the present invention.

Explanation of the Present Disclosure

Figure 4:
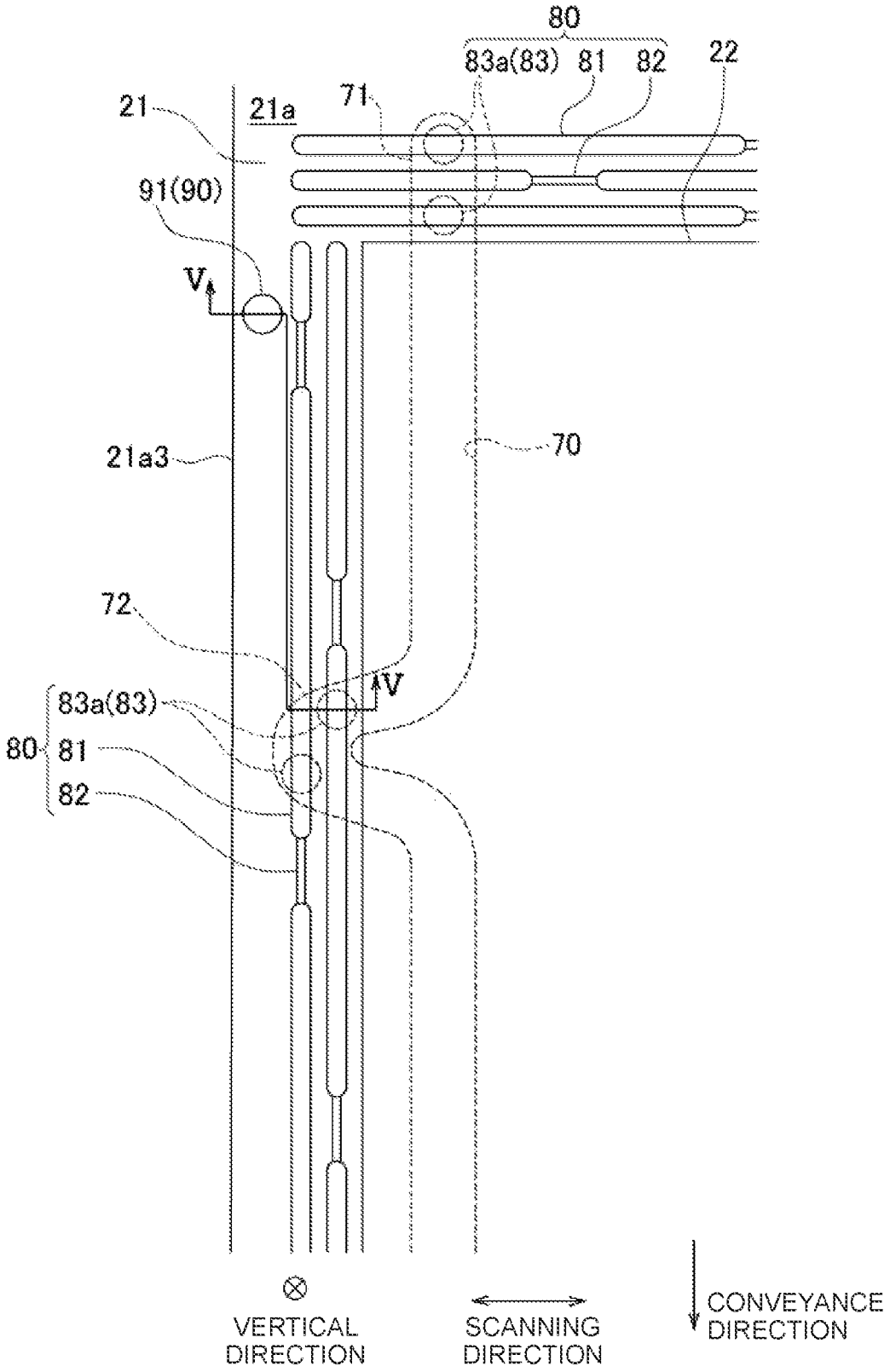
FIG. 4 is an enlarged view of an area IV depicted in FIG. 2.
Figure 5:
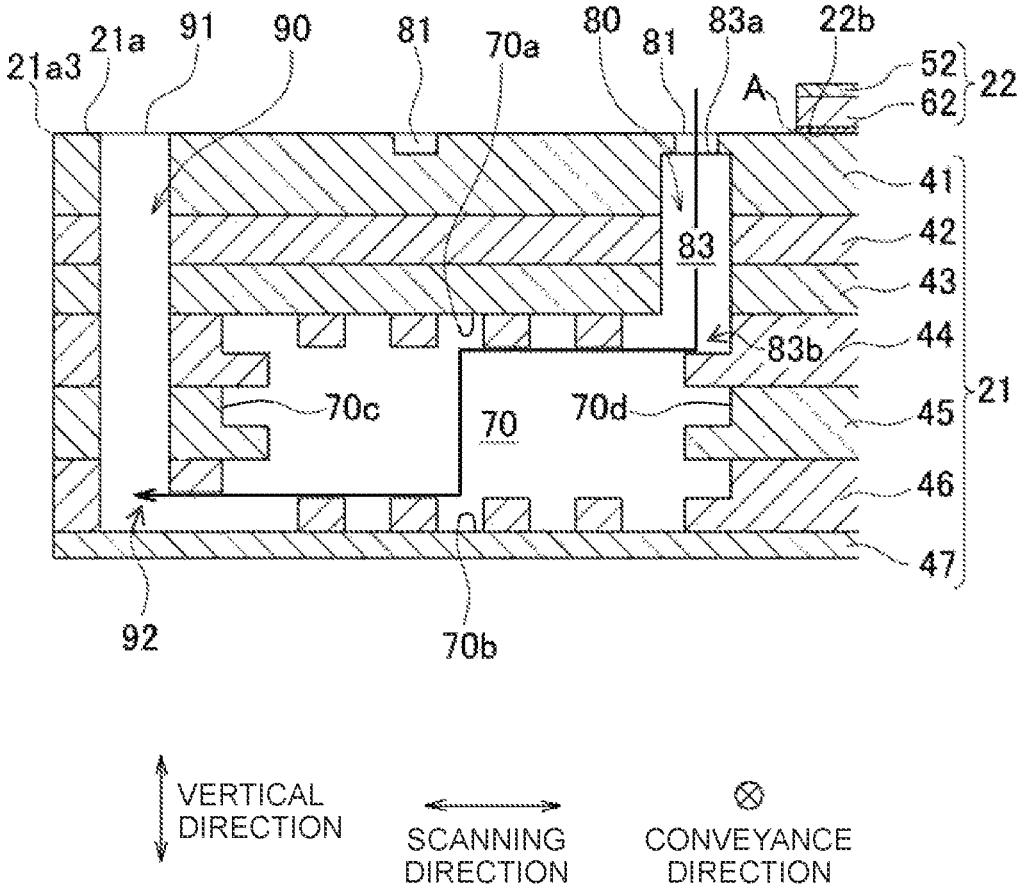
FIG. 5 is a cross-sectional view along a V-V line in FIG. 4.

The channel substrate 21 further has a trap chamber 70 which is configured to trap the adhesive A, an inflow channel 80 into which the adhesive A flows toward the trap chamber 70, and an atmosphere communicating channel 90 which is configured to communicate the trap chamber 70 with the atmosphere, as depicted in FIGS. 2, 4 and 5. The trap chamber 70, the inflow channel 80 and the atmosphere communicating channel 90 are formed symmetrically with respect to an axis extending along the conveyance direction and passing through the center in the scanning direction of the channel substrate 21, as depicted in FIG. 2.

As depicted in FIGS. 2 and 4, the inflow channel 80 is formed along the outer circumference of the actuator substrate 22, and includes a plurality of grooves 81, connecting channels 82 of which width are narrower than those of the plurality of grooves 81 and which connect two of the plurality of grooves 81 to each other, and a through hole 83 formed in a bottom part of some of the plurality of grooves 81. The plurality of grooves 81 and the connecting grooves 82 are opened in the upper surface 21*a* of the channel substrate 21, and construct (or define) an end of the inflow channel 80 (an example of "first end"). As depicted in FIG. 5, the through hole 83 has one end 83*a* connecting to the bottom part of the groove 81, and the other end 83*b* connecting to the trap chamber 70, and extends in the vertical direction from the one end 83*a* to the other end 83*b*. The other end 83*b* constructs the other end of the inflow channel 80 (an example of "second end").

As depicted in FIG. 2, the plurality of grooves 81 and the connecting grooves 82 do not overlap with the actuator substrate 22 as seen in the vertical direction. Between each of outer edges 21*a*1 and 21*a*2 in the conveyance direction of the upper surface 21*a* of the channel substrate 21 and the actuator substrate 22, the plurality of grooves 81 and the connecting grooves 82 are arranged in the vicinity of a short side (a side extending along the scanning direction) of the actuator substrate 22, each extend in the scanning direction, and form three rows (arrays) arranged side by side in the conveyance direction. Between each of outer edges 21*a*3 and 21*a*4 in the scanning direction of the upper surface 21*a* of the channel substrate 21 and the actuator substrate 22, the plurality of grooves 81 and the connecting grooves 82 are arranged in the vicinity of a long side (a side extending along the conveyance direction) of the actuator substrate 22, each extend in the conveyance direction, and form two rows (arrays) arranged side by side in the scanning direction. In each of the rows, the groove 81 and the connecting groove 82 are alternately arranged. Note that it is allowable to further provide a linking groove which links a groove 81 in a certain row to another groove 81 in another row adjacent to the certain row.

As depicted in FIGS. 2 and 5, the atmosphere communicating channel 90 has one end 91 (an example of "first end") opened in the upper surface 21*a* of the channel substrate 21, and the other end 92 (an example of "second end") connecting to the trap chamber 70. The one end 91 does not overlap with the actuator substrate 22 as seen in the vertical direction, and communicates with the atmosphere. As depicted in FIG. 2, the one end 91 is arranged between the long side (the side along the conveyance direction) of the actuator substrate 22 and each of the outer edges 21*a*3 and 21*a*4 of the channel substrate 21; one piece of the one end 91 is arranged at each of four corners of the actuator substrate 22, namely, four pieces of the one end 91 are provided in total. A spacing distance between the one end 91 and each of the outer edges 21*a*3 and 21*a*4 is smaller than a spacing distance between grooves 81 and connecting grooves 82 constructing the one end of the inflow channel 80 and each of the outer edges 21*a*3 and 21*a*4. Namely, the one end 91 is located at the outside with respect to the grooves 81 and the connecting grooves 82.

As depicted in FIG. 2, each of the trap chambers 70 extends in the conveyance direction along the long side of the actuator substrate 22, at each of one end and the other end in the scanning direction of the actuator substrate 22. Each of the trap chambers 70 is bent so as to include a part overlapping with the actuator substrate 22 as seen in the vertical direction, a first part 71 projecting in the conveyance direction with respect to the actuator substrate 22, and a second part 72 projecting in the scanning direction with respect to the actuator substrate 22. Each of the trap chambers 70 has the first part 71 at the both ends in the conveyance direction (namely, each of the trap chambers 70 projects to each of the upstream side and the downstream side in the conveyance direction, with respect to the actuator substrate 22). Further, each of the trap chambers 70 has four pieces of the second part 72 in total.

A plurality of pieces of the through hole 83 is provided with respect to each of the trap chambers 70. Specifically, two pieces of the through hole 83 are provided on each of the first parts 71, and two pieces of the through hole 83 are provided on each of the second parts 72.

As depicted in FIG. 0.5, each of the trap chambers 70 is formed in the plates 44 to 46 in which the four common channels 29 (see FIG. 3) are formed. An upper end 70*a* (an example of first end in the first direction) of the trap chamber 70 has concavities and convexities (unevenness) by a patterning formed in the plate 44. A lower end 70*b* (an example of second end in the first direction) of the trap chamber 70 has concavities and convexities by a patterning formed in the plate 46. An outer end 70*c* (an example of first end in the second direction) of the trap chamber 70 has concavities and convexities by a patterning formed in the plates 44 and 45. An inner end 70*d* (an example of second end in the second direction) of the trap chamber 70 has concavities and convexities by a patterning formed in the plates 44 to 46.

A spacing distance between the upper end 70*a* of the trap chamber 70 and the upper surface 21*a* of the channel substrate 21 is smaller than a spacing distance between the lower end 70*b* of the trap chamber 70 and the upper surface 21*a* of the channel substrate 21. Namely, the upper end 70*a* is closer to the upper surface 21*a* than the lower end 70*b*.

In a trap chamber 70, among the trap chambers 70, on the left side of the FIG. 2, a spacing distance between the outer end 70*c* (see FIG. 5) and the outer edge 21*a*3 of the channel substrate 21 is smaller than a spacing distance between the inner end 70*d* (see FIG. 5) and the outer edge 21*a*3 of the channel substrate 21. In a trap chamber 70, among the trap chambers 70, on the right side of the FIG. 2, a spacing distance between the outer end 70*c* (see FIG. 5) and the outer edge 21*a*4 of the channel substrate 21 is smaller than a spacing distance between the inner end 70*d* (see FIG. 5) and the outer edge 21*a*4 of the channel substrate 21. Namely, the outer end 70*c* is closer to the outer edge 21*a*3 or 21*a*4 than the inner end 70*d*.

Each of the plurality of through holes 83 of the inflow channel 80 extends in the vertical direction from the one end 83*a* to the other end 83*b*, as described above. On the other hand, the atmosphere communicating channel 90 has a first part extending from the one end 91 in the vertical direction, and a second part extending from the first part in the conveyance direction and reaching the other end 92. As depicted in FIG. 2, the one end 83*a* of the through hole 83 and the one end 91 of the atmosphere communicating channel 90 are separated from each other in the conveyance direction. Further, a channel length of the atmosphere communicating channel 90 is longer than a channel length of the inflow channel 80.

As depicted in FIG. 5, the other end 83*b* of the through hole 83 (the other end of the inflow channel 80) is positioned at the upper end 70*a* and at the inner end 70*d* of the trap chamber 70, and the other end 92 of the atmosphere communicating channel 90 is positioned at the lower end 70*b* and the outer end 70*c* of the trap chamber 70. Namely, the other end 83*b* of the through hole 83 (the other end of the inflow channel 80) and the other end 92 of the atmosphere communicating channel 90 are arranged on a diagonal line with respect to the trap chamber 70, as seen from the conveyance direction. Further, although omitted in the drawings, the other end 83*b* of the through hole 83 (the other end of the inflow channel 80) and the other end 92 of the atmosphere communicating channel 90 are separated from each other in the conveyance direction.

In a case that the channel substrate 21 and the actuator substrate 22 are joined (adhered) to each other, any excessive portion of the adhesive A provided between the upper surface 21*a* of the channel substrate 21 and the lower surface 22*b* of the actuator substrate 22 is extruded or forced out to the outside of the actuator substrate 22, and enters into the groove 81 and/or the connecting groove 82. In this situation, as depicted in FIG. 2, the adhesive A extruded to the outside of the long side of the actuator substrate 22 enters into the groove 81 and/or the connecting groove 82 provided along the long side of the actuator substrate 22, and the adhesive A extruded to the outside of the short side of the actuator substrate 22 enters into the groove 81 and/or the connecting groove 82 provided along the short side of the actuator substrate 22.

The adhesive A extruded to the outside of the long side of the actuator substrate 22 and entered into the groove 81 and/or the connecting groove 82 provided along the long side of the actuator substrate 22 passes the through hole 83 provided on the bottom part of the groove 81, and flows into the trap chamber 70 from the other end 83*b* of the through hole 83 (see an arrow in FIG. 5).

The adhesive A extruded to the outside of the short side of the actuator substrate 22 and entered into the groove 81 and/or the connecting groove 82 provided along the short side of the actuator substrate 22 passes the groove 81 and the connecting groove 82, and moves in the scanning direction toward the long side of the actuator substrate 22. Then, the adhesive A passes the through hole 83 provided on the first part 71 of the trap chamber 70, and flows into the trap chamber 70 from the other end 83*b* of the through hole 83 (see an arrow in FIG. 5).

The adhesive A flowed into the trap chamber 70 flows along a wall surface (a side surface, a ceiling surface, a bottom surface, etc.) of the trap chamber 70, and flows toward the other end 92 of the atmosphere communicating channel 90. Note, however, that in the present embodiment, since a route or path via which the adhesive A flows along the wall surface of the trap chamber 70 from the other end 83*b* and reaching up to the other end 92 is made long as will be described in the following, such a situation that the adhesive A flowed into the trap chamber 70 reaches the other end 92 (consequently, the adhesive A flowed out from the one end 91) is suppressed.

The Configuration and Effect of the Present Embodiment

As described above, according to the present embodiment, the other end 83*b* of the through hole 83 (the other end of the inflow channel 80) is positioned at the upper end 70*a* and the inner end 70*d* of the trap chamber 70, and the other end 92 of the atmosphere communicating channel 90 is positioned at the lower end 70*b* and the outer end 70*c* of the trap chamber 70 (namely, the other end 83*b* and the other end 92 are positioned on the diagonal line with respect to the trap chamber 70), as depicted in FIG. 5. With this, for example, as compared with a case that the other end 83*b* and the other end 92 are both positioned at the upper end 70*a* of the trap chamber 70, it is possible to make the route, via which the adhesive A flows along the wall surface of the trap chamber 70 from the other end 83*b* and reaching up to the other end 92, be long, and consequently to suppress such a situation that the adhesive A flows out of the one end 91 of the atmosphere communicating channel 90. Namely, according to the present embodiment, it is possible to suppress such a situation that the adhesive A adhering the channel substrate 21 and the actuator substrate 22 flows out of the one end 91 of the atmosphere communicating channel 90.

Each of the outer end 70*c* and the inner end 70*d* of the trap chamber 70 has the concavities and convexities (see FIG. 5). With this, since the route via which the adhesive A flows along the side surface of the trap chamber 70 becomes long, it is possible to suppress, in an ensured manner, such a situation that the adhesive A flows out of the one end 91 of the atmosphere communicating channel 90.

Each of the upper end 70*a* and the lower end 70*b* of the trap chamber 70 has the concavities and convexities (see FIG. 5). With this, since the route via which the adhesive A flows along the top surface and/or the bottom surface of the trap chamber 70 becomes long, it is possible to suppress, in an ensured manner, such a situation that the adhesive A flows out of the one end 91 of the atmosphere communicating channel 90.

The channel length of the atmosphere communicating channel 90 is longer than the channel length of the inflow channel 80. Accordingly, it is possible to suppress, in an ensured manner, such a situation that the adhesive A flows out of the one end 91 of the atmosphere communicating channel 90.

The plurality of grooves 81 and the connecting grooves 82 (the one end of the inflow channer 80) do not overlap with the actuator substrate 22 as seen in the vertical direction (see FIG. 2). With this, it is possible to make the adhesive A, extruded to the outside of the actuator substrate 22, to flow into the trap chamber 70 from the plurality of grooves 81 and the connecting grooves 82. Further, in a case that the plurality of grooves 81 and the connecting grooves 82 (the one end of the inflow channer 80) overlap with the actuator substrate 22 as seen in the vertical direction, any unsatisfactory adhesion between the channel substrate 21 and the actuator substrate 22 might occur. In view of this point, in the present embodiment, since the plurality of grooves 81 and the connecting grooves 82 (the one end of the inflow channer 80) do not overlap with the actuator substrate 22 as seen in the vertical direction, it is possible to suppress any unsatisfactory adhesion.

A plurality of pieces of the through hole 83 are provided with respect to one piece of the trap chamber 70 (see FIG. 2). With this, it is possible to make a larger amount of the adhesive A to flow into the trap chamber 70 via the inflow channel 80.

The actuator substrate 22 is long in the conveying direction, and the trap chambers 70 extend in the conveyance direction, both at the one end and the other end, respectively, in the scanning direction of the actuator substrate 22 (namely, along the long sides of the actuator substrate 22) (see FIG. 2). With this, it is possible to make the volume of the trap chamber 70 be great, and to make the adhesive A extruded to the outside of the long side(s) of the actuator substrate 22 to sufficiently flow into the trap chamber 70.

The other end 83*b* of the through hole 83 (the other end of the inflow channel 80) and the other end 92 of the atmosphere communicating channel 92 are separated from each other in the conveyance direction. With this, it is possible to make the route, via which the adhesive A flows from the other end 83*b* along the wall surface of the trap chamber 70 and reaching up to the other end 92 to be longer, thereby making it possible to suppress, in an ensured manner, such a situation that the adhesive A flows out of the one end 91 of the atmosphere communicating channel 90.

The plurality of grooves 81 and the connecting grooves 82 which construct the one end of the inflow channel 80 are formed at the locations each of which is between the actuator substrate 22 and one of the outer edges 21*al* and 21*a*2 in the conveyance direction of the channel substrate 21 (see FIG. 2). With this, it is possible to make the adhesive A extruded to the outside of the short side(s) of the actuator substrate 22 to flow into the trap chamber 70 via the plurality of grooves 81 and the connecting grooves 82.

The plurality of grooves 81 and the connecting grooves 82 extend in the scanning direction at the locations each of which is between the actuator substrate 22 and one of the outer edges 21*al* and 21*a*2 in the conveyance direction of the channel substrate 21 (see FIG. 2). With this, it is possible to easily realize an operation of making the adhesive A extruded to the outside of the short side of the actuator substrate 22 to flow into the trap chamber 70, which is provided in the vicinity of the long side of the actuator substrate 22, via the plurality of grooves 81 and the connecting grooves 82.

Each of the trap chambers 70 has the first part 71 projecting in the conveyance direction with respect to the actuator substrate 22, and the second part 72 projecting in the scanning direction with respect to the actuator substrate 22 (see FIG. 2). With this, it is possible to receive the adhesive A extruded to the outside of the short side of the actuator substrate 22 by the first part 71, and to receive the adhesive A extruded to the outside of the long side of the actuator substrate 22 by the second part 72.

Each of the trap chambers 70 is bent so as to include the first part 71 and the second part 72 (see FIG. 2). By making each of the trap chambers 70 to have such a bent shape, it is possible to secure the rigidity of a part, of the channel substrate 21, which defines each of the trap chambers 70 even in a case that each of the trap chambers 70 is made to be thin or slim (and consequently to realize a small-sized head 3, as compared with a case in which the trap chamber 70 is made thick).

MODIFICATIONS

In the foregoing, the embodiment of the present invention has been explained. The present invention, however, is not limited to or restricted by the above-described embodiment; it is allowable to make a various kind of design changes to the present disclosure, within the scope described in the claims.

In the above-described embodiment (see FIG. 2), the trap chamber 70 is bent as seen from the vertical direction. However, there is no limitation thereto. For example, it is allowable that the trap chamber 70 has a linear shape as seen from the vertical direction.

In the above-described embodiment (see FIG. 2), the trap chamber 70 has the part overlapping with the actuator substrate 22 as seen in the vertical direction, and the parts not overlapping with the actuator substrate 22 as seen in the vertical direction (the first part 71 and the second part 72). However, there is no limitation thereto. For example, it is allowable that the trap chamber 70 has only the part not overlapping with the actuator substrate 22 as seen in the vertical direction.

In the above-described embodiment (see FIG. 2), the inflow channel 80 is formed in the entire circumference of the actuator substrate 22. However, there is no limitation thereto. For example, it is allowable that the inflow channel 80 is provided only on the long side or the short side of the actuator substrate 22.

In the above-described embodiment (see FIG. 5), the groove 81 does not penetrate through the plate 41. However, it is allowable to configure that the groove 81 penetrates the plate 41 and reaches the upper surface of the plate 42. In this case, since the groove 81 is capable of receiving a large amount of the adhesive A, it is possible to effectively suppress such a problem that the adhesive A extrudes to the outside of the channel substrate 21 and/or that the adhesive A enters into the atmosphere communicating channel 91.

In the above-described embodiment (see FIG. 2), the inflow channel 80 includes the plurality of grooves 81, the connecting grooves 82 and the through holes 83. The present disclosure, however, is not limited to this. For example, it is allowable that the plurality of grooves 81, the connecting grooves 82 are omitted, and that the inflow channel 80 is constructed only of the through hole(s) 83. In this case, the one end 83*a* of the through hole 83 may be opened in the upper surface 21*a* of the channel substrate 21.

In the above-described embodiment, the other end 83*b* of the through hole 83 (the other end of the inflow channel 80) and the other end 92 of the atmosphere communicating channel 90 are separated from each other in the conveyance direction. However, there is no limitation thereto. For example, it is allowable that the other end 83*b* of the through hole 83 and the other end 92 of the atmosphere communicating channel 90 are located at a same position in the conveyance direction.

In the above-described embodiment (see FIG. 5), each of the upper end 70*a*, the lower end 70*b*, the outer end 70*c* and the inner end 70*d* of the trap chamber 70 has the concavities and convexities (unevenness). The present disclosure, however, is not limited to this. For example, it is allowable that only any one of the upper end 70*a*, the lower end 70*b*, the outer end 70*c* and the inner end 70*d* has the concavities and convexities (unevenness). Alternatively, it is allowable that all of the upper end 70*a*, the lower end 70*b*, the outer end 70*c* and the inner end 70*d* of the trap chamber 70 do not have the concavities and convexities.

In the above-described embodiment, although the other end 83*b* of the through hole 83 is positioned at the upper end 70*a* and the inner end 70*d* of the trap chamber 70 and the other end 92 of the atmosphere communicating channel 90 is positioned at the lower end 70*b* and the outer end 70*c* of the trap chamber 70. However, there is no limitation thereto. For example, it is allowable that the other end 83*b* of the through hole 83 is positioned at one of the upper end 70*a* and the lower end 70*b* of the trap chamber 70, and that the other end 92 of the atmosphere communicating channel 90 is positioned at the other of the upper end 70*a* and the lower end 70*b* of the trap chamber 70. Alternatively, it is allowable that the other end 83*b* of the through hole 83 is positioned at one of the outer end 70*c* and the inner end 70*d* of the trap chamber 70, and that the other end 92 of the atmosphere communicating channel 90 is positioned at the other of the outer end 70*c* and the inner end 70*d* of the trap chamber 70. Even by these aspects, it is possible to make the route, via which the adhesive A flows along the wall surface of the trap chamber 70 from the other end 83*b* and reaching up to the other end 92, be long, and consequently to suppress such a situation that the adhesive A flows out of the one end 91 of the atmosphere communicating channel 90.

The applicability of the present disclosure is not limited to the printer, and the present disclosure is applicable also to a facsimile machine, a copying machine, a multi-functional peripheral, etc. Further, the present disclosure is applicable also to a liquid discharge apparatus which is usable in an usage different from the recording of an image (for example, a liquid discharge apparatus which is configured to discharge a conductive liquid to a substrate so as to form a conductive pattern on the substrate).

What is claimed is:

1. A liquid discharge head comprising:

a channel substrate in which a plurality of individual channels is formed and which has a first surface, each of the plurality of individual channels including a nozzle and a pressure chamber communicating with the nozzle; and an actuator substrate having a second surface which is adhered to the first surface via an adhesive, the actuator substrate having a plurality of individual electrodes each of which overlaps with the pressure chamber of one of the plurality of individual channels as seen in a first direction orthogonal to the first surface and the second surface, wherein a trap chamber configured such that the adhesive is trapped in the trap chamber in a case that the first and second surfaces are adhered to each other via the adhesive, an inflow channel configured such that the adhesive flows into the inflow channel toward the trap chamber in a case that the first and second surfaces are adhered to each other via the adhesive, and an atmosphere communicating channel configured to communicate the trap chamber with atmosphere are formed in the channel substrate;

the inflow channel has a first end which is opened in the first surface and a second end which is connected to the trap chamber;

the atmosphere communicating channel has a first end which is opened in the first surface, which does not overlap with the actuator substrate as seen in the first direction and which is communicated with the atmosphere, and a second end which is connected to the trap chamber;

a distance between the first end of the atmosphere communicating channel and an outer edge, of the first surface, in a second direction orthogonal to the first direction is smaller than a distance between the first end of the inflow channel and the outer edge, of the first surface, in the second direction;

the trap chamber has a first end and a second end in the first direction and a first end and a second end in the second direction, a distance between the first end in the first direction and the first surface being smaller than a distance between the second end in the first direction and the first surface, and a distance between the first end in the second direction and the outer edge of the first surface in the second direction being smaller than a distance between the second end in the second direction and the outer edge of the first surface in the second direction;

the second end of the inflow channel is located at the first end in the first direction and the second end in the second direction of the trap chamber; and the second end of the atmosphere communicating channel is located at the second end in the first direction and the first end in the second direction of the trap chamber, wherein the channel substrate includes a plurality of substrates stacked on each other, the inflow channel being formed in a first substrate of the plurality of substrates, the trap chamber being formed in a second substrate, of the plurality of substrates, different from the first substrate.

2. The liquid discharge head according to claim 1, wherein at least one of the first end in the second direction of the trap chamber and the second end in the second direction of the trap chamber has a concavity and a convexity.

3. The liquid discharge head according to claim 1, wherein at least one of the first end in the first direction of the trap chamber and the second end in the first direction of the trap chamber has a concavity and a convexity.

4. The liquid discharge head according to claim 1, wherein a channel length of the atmosphere communicating channel is longer than a channel length of the inflow channel.

5. The liquid discharge head according to claim 1, wherein the first end of the inflow channel does not overlap with the actuator substrate as seen in the first direction.

6. The liquid discharge head according to claim 1, wherein the inflow channel is a plurality of channels provided with respect to the trap chamber.

7. The liquid discharge head according to claim 1, wherein the actuator substrate has a length, in a third direction orthogonal to the first direction and crossing the second direction, which is longer than a length in the second direction of the actuator substrate; and the trap chamber includes a first trap chamber extending in the third direction at a first end in the second direction of the actuator substrate and a second trap chamber extending in the third direction at a second end in the second direction of the actuator substrate.

8. The liquid discharge head according to claim 7, wherein the second end of the inflow channel and the second end of the atmosphere communicating channel are separated from each other in the third direction.

9. The liquid discharge head according to claim 7, wherein a common channel which communicates with the plurality of individual channels, which extends in the third direction and which projects in the third direction with respect to the actuator substrate is formed in the channel substrate; and a groove which constructs the first end of the inflow channel is formed on the first surface at a position between an outer edge in the third direction of the first surface and the actuator substrate.

10. The liquid discharge head according to claim 9, wherein the groove extends in the second direction.

11. The liquid discharge head according to claim 7, wherein the trap chamber has a first part projecting in the third direction with respect to the actuator substrate, and a second part projecting in the second direction with respect to the actuator substrate.

12. The liquid discharge head according to claim 11, wherein the trap chamber is bent so as to include the first part and the second part.

13. A liquid discharge head comprising:

a channel substrate in which a plurality of individual channels is formed and which has a first surface, each of the plurality of individual channels including a nozzle and a pressure chamber communicating with the nozzle; and an actuator substrate having a second surface which is adhered to the first surface via an adhesive, the actuator substrate having a plurality of individual electrodes each of which overlaps with the pressure chamber of one of the plurality of individual channels as seen in a first direction orthogonal to the first surface and the second surface, wherein a trap chamber configured such that the adhesive is trapped in the trap chamber in a case that the first and second surfaces are adhered to each other via the adhesive, an inflow channel configured such that the adhesive flows into the inflow channel toward the trap chamber in a case that the first and second surfaces are adhered to each other via the adhesive, and an atmosphere communicating channel configured to communicate the trap chamber with atmosphere are formed in the channel substrate;

the inflow channel has a first end which is opened in the first surface and a second end which is connected to the trap chamber;

the atmosphere communicating channel has a first end which is opened in the first surface, which does not overlap with the actuator substrate as seen in the first direction and which is communicated with the atmosphere, and a second end which is connected to the trap chamber;

a distance between the first end of the atmosphere communicating channel and an outer edge, of the first surface, in a second direction orthogonal to the first direction is smaller than a distance between the first end of the inflow channel and the outer edge, of the first surface, in the second direction;

the trap chamber has a first end and a second end in the first direction and a first end and a second end in the second direction, a distance between the first end in the first direction and the first surface being smaller than a distance between the second end in the first direction and the first surface, and a distance between the first end in the second direction and the outer edge of the first surface in the second direction being smaller than a distance between the second end in the second direction and the outer edge of the first surface in the second direction; and the second end of the inflow channel is located at a first one of the first end and the second end in the first direction of the trap chamber and the second end of the atmosphere communicating channel is located at a second one of the first end and the second end in the first direction of the trap chamber, or the second end of the inflow channel is located at a first one of the first end and the second end in the second direction of the trap chamber and the second end of the atmosphere communicating channel is located at a second one of the first end and the second end in the second direction of the trap chamber, wherein the channel substrate includes a plurality of substrates stacked on each other, the inflow channel being formed in a first substrate of the plurality of substrates, the trap chamber being formed in a second substrate, of the plurality of substrates, different from the first substrate.

* * * * *